US007789522B2

(12) United States Patent
Steadman

(10) Patent No.: US 7,789,522 B2
(45) Date of Patent: Sep. 7, 2010

(54) LIGHTING DEVICE WITH A WALLWASH REFLECTOR ASSEMBLY

(75) Inventor: Connie A. Steadman, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 365 days.

(21) Appl. No.: 11/896,482

(22) Filed: Aug. 31, 2007

(65) Prior Publication Data

US 2009/0059600 A1 Mar. 5, 2009

(51) Int. Cl.
*F21V 17/02* (2006.01)

(52) U.S. Cl. ..... 362/147; 362/148; 362/366; 362/365

(58) Field of Classification Search ..... 362/147, 362/148, 365, 366
See application file for complete search history.

(56) References Cited

U.S. PATENT DOCUMENTS

| | | | | |
|---|---|---|---|---|
| 4,475,147 | A | 10/1984 | Kristofek | |
| 5,800,050 | A | 9/1998 | Leadford | |
| 5,918,969 | A | 7/1999 | Chu et al. | |
| RE36,908 | E | 10/2000 | Ling | |
| 6,350,047 | B1 | 2/2002 | Ng et al. | |
| 6,357,894 | B1 | 3/2002 | Chu et al. | |
| 6,431,723 | B1 | 8/2002 | Schubert et al. | |
| 6,561,670 | B1 | 5/2003 | Jongewaard et al. | |
| 6,632,006 | B1 | 10/2003 | Rippel et al. | |
| 6,942,364 | B1 | 9/2005 | Wegner et al. | |
| 6,994,456 | B1 | 2/2006 | Russo et al. | |
| 7,125,135 | B2 | 10/2006 | Ward | |
| 7,384,167 | B1 * | 6/2008 | Gamache et al. | 362/147 |
| 2004/0090784 | A1 | 5/2004 | Ward | |
| 2006/0120078 | A1 | 6/2006 | Klose | |
| 2007/0047236 | A1 | 3/2007 | Wilson et al. | |

* cited by examiner

*Primary Examiner*—Anabel M Ton
(74) *Attorney, Agent, or Firm*—Garrett V. Davis; Mark S. Bicks; Alfred N. Goodman

(57) ABSTRACT

A wallwash reflector assembly includes a downlight body mounted within a wallwash body, the wallwash body being of multi-piece construction including an active body having an upper wallwash reflector for illuminating a first portion of a wall and a wallside body having a lower wallwash reflector for illuminating for a second portion of the wall. The upper and lower wallwash reflectors are optically optimized to provide a smooth, imperceptible transition between the illumination provided to the wall by the upper wallwash reflector and the illumination provided to the wall by the lower wallwash reflector.

23 Claims, 9 Drawing Sheets

LIGHTING DEVICE WITH A WALLWASH REFLECTOR ASSEMBLY

BACKGROUND OF THE INVENTION

1. Field of the Invention

The present invention relates to generally a reflector assembly for a lighting device. More particularly, the present invention relates to a reflector assembly, which provides general illumination to an architectural space and also directs a portion of the light specifically to at least one non-horizontal surface, including walls, of the architectural space.

2. Description of Related Art

Specialized recessed lighting fixtures, which are adapted to illuminate at least one wall adjacent the fixture, i.e. to "wash" the wall with light, are well established in the prior art. For example, U.S. Pat. No. 4,475,147 to Kristofek discloses a wallwash reflector assembly wherein a "kicker" is mounted within a conventional downlight reflector to direct light to illuminate a wall opposite the "kicker". In this design, the extra components that make up the wallwash feature of the fixture are visible to the occupants in the space. Additionally, these extra components extend slightly below the ceiling plane. The physical appearance of this design is therefore unavoidably different from that of standard fully recessed fixtures. Similarly, U.S. Pat. Nos. 5,800,050 to Leadford, U.S. Pat. No. 6,561,070 to Jongewaard et al., and RE 36,908 to Ling each disclose reflector assemblies including a wallwash "kicker". All of the above mentioned reflector assemblies are limited in their design in that a "kicker" is capable of directing light to at most one wall. An additional limitation of utilizing a "kicker" is that a significant redesign of the product would be necessary to adapt the wallwash reflector assembly into a 'double wallwash' reflector assembly, a 'corner wallwash' reflector assembly, or any other specialized distribution. Additionally, due to material relaxation principles, the most common manufacturing methods cause the "kicker" to vary in contour from its original design as well as from part to part.

U.S. Pat. No. 6,350,047 discloses a reflector assembly which includes a wallwash "kicker" that has limitations similar to those described above. This "kicker" is additionally problematic in that it is flexible and is therefore susceptible to producing uneven illumination onto the wall if unintentionally or inappropriately flexed, for example, as a result of incorrect installation or if the "kicker" deforms and does not return completely to the original contours it had before it was flexed. Another factor that may lead to the fixture being improperly installed is that the manufacturer provides multiple components to the contractor in the field for a single fixture assembly. This design requires the contractor to receive all of the components, to catalog them together until ready to install them, and to understand what each piece is for and how the assembly goes together. The complicated assembly requires additional time to be spent on the assembly of each fixture. Each time the fixture is inspected or serviced, multiple components must be removed and then reassembled, allowing for the possibility of incorrect reassembly.

U.S. Pat. Nos. 6,431,723, to Schubert et al., U.S. Pat. No. 6,632,006 to Rippel et al. and U.S. Pat. No. 7,125,135 to Ward each disclose wallwash reflector assemblies that are designed to have the light source tilted at an angle less than 90 degrees (but not parallel) to the ceiling line or off-axis inside the wallwash reflector assembly in order to direct a higher percentage of the light from the light source toward the wall to be illuminated. However, all of the above mentioned reflector assemblies are limited in their design in that they are capable of directing light to at most one wall. Additionally, this methodology complicates the fabrication and assembly of the reflector assembly and of the lighting device. Furthermore, these reflector assemblies, as well as the previously discussed reflector assembly of U.S. Pat. No. 6,561,070 to Jongewaard, utilize lenses, which adds to their complexity and cost.

Accordingly, there is a need for a rigid, truly recessed wallwash reflector assembly that resembles a downlight reflector assembly from the architectural space, and that is designed for a centrally located light source mounted perpendicular or parallel to the mounting surface, does not require a lens, is simple to manufacture, assemble, and customize, and is capable of directing light to a plurality of non-horizontal surfaces, including walls, from the top of the non-horizontal surfaces to the bottom of the non-horizontal surfaces while also contributing to the illumination of the architectural space.

SUMMARY OF THE INVENTION

An aspect of the present invention is to address at least the above-mentioned problems and disadvantages with related art devices and also to provide at least the advantages described below. Accordingly, an aspect of the present invention is to provide a rigid, annular wallwash reflector assembly that incorporates a downlight reflector.

According to an aspect of the present invention, the wallwash reflector assembly is fully recessed within a mounting surface.

According to an aspect of the present invention, the wallwash reflector assembly is of a multi-piece construction including an annular active body and an annular wallside body that when combined function to uniformly illuminate at least one adjacent wall from the top of the wall to the bottom of the wall.

According to an aspect of the present invention, a single tool forms the active body and a separate single tool forms the wallside body and then the two bodies are mated together.

According to an aspect of the present invention, the active body and the wallside body are precisely mated together by secure and stabilizing means.

According to an aspect of the present invention, the active body and the wallside body are mated together by applying tabs and slots or by utilizing hardware.

According to an aspect of the present invention, the tools that form the active body and the wallside body are of a high quality, created with highly precise techniques, and easy to maintain.

According to an aspect of the present invention, each active body part and each wallside body part will be precise.

According to an aspect of the present invention, mating together the active body and the wallside body creates a physical transition between the two bodies that is exposed to the interior of the wallwash reflector assembly.

According to an aspect of the present invention, the physical transition exposed to the interior of the wallwash reflector assembly is optically precise.

According to an aspect of the present invention, all body edges and body surfaces exposed to the interior of the wallwash reflector assembly is controlled and intentional, which causes the physical transition exposed to the interior of the wallwash reflector to be optically precise.

According to an aspect of the present invention, the single tool that forms the active body and the single tool that forms the wallside body can be maintained separately.

According to an aspect of the present invention, the single tool that forms the active body and the single tool that forms the wallside body retain their preciseness over use as these tools are easy to maintain and are maintained with highly precise techniques.

According to an aspect of the present invention, each active body part and each wallside body part pulled off of the tools over time will be precise.

According to an aspect of the present invention, all body edges and body surfaces exposed to the interior of the wallwash reflector assembly will be controlled and intentional over tool usage as the body parts are pulled off of these precisely maintained tools.

According to an aspect of the present invention, the physical transition between the active body and the wallside body, which is exposed to the interior of the wallwash reflector assembly, is optically precise over tool usage as the body parts are pulled off of these precisely maintained tools.

According to an aspect of the present invention, the controlled and intentional design of all body edges and body surfaces exposed to the interior of the wallwash reflector assembly results in a smooth and uniform illumination pattern on the wall.

According to an aspect of the present invention, the purposeful design of all body edges and body surfaces exposed to the interior of the wallwash reflector assembly results in the elimination of light errantly reflecting from the active body and the wallside body into the downlight body.

According to an aspect of the present invention, the purposeful design of all body edges and body surfaces exposed to the inside of the wallwash reflector assembly results in the elimination of the "flashing" effect that occurs when light rays are reflected to and then off of the downlight reflector into the architectural space at high vertical angles.

According to an aspect of the present invention, the downlight body provides general illumination to the architectural space with high visual comfort.

According to an aspect of the present invention, the wallwash reflector assembly can be laterally rotated to any angle within a 360-degree range of rotation after it is installed into the mounting surface.

According to an aspect of the present invention, the wallwash reflector assembly can be installed into and removed from the mounting surface at all lateral rotation angles from below the ceiling.

The foregoing objects are basically attained by providing a wallwash reflector assembly for placement within a mounting surface adjacent to a wall and for use with a light source, comprising a wallwash body having an annular configuration and having an annular wallwash reflector for directing light from the light source to illuminate the wall; and a downlight body having a downlight reflector for directing light from the light source to provide illumination to an architectural space adjacent the wall.

The foregoing objects are further attained by providing a wallwash reflector assembly for placement within a mounting surface adjacent to a wall and for use with a light source, comprising an active body having an annular configuration and an upper wallwash reflector for reflecting light from the light source to illuminate a first portion of the wall, and a wallside body having an annular configuration and a lower wallwash reflector for reflecting light from the light source to illuminate a second portion of the wall.

The foregoing objects are further attained by providing a wallwash reflector assembly having a central axis for placement within a mounting surface adjacent to a wall and for use with a light source, comprising an active body having an annular configuration and an upper wallwash reflector for reflecting light from the light source to illuminate a first portion of the wall, a wallside body having an annular configuration and a lower wallwash reflector for reflecting light from the light source to illuminate a second portion of the wall, and a downlight body having a downlight reflector for directing light from the light source to illuminate an architectural space adjacent the wall, wherein the downlight body includes two cutouts for exposing to the light source at least two portions of the upper wallwash reflector and at least two portions of the lower wallwash reflector.

The foregoing objects are further attained by providing for a method of making a wallwash body, comprising forming on a first single tool an active body having an annular configuration and an upper wallwash reflector, forming on a second single tool a wallside body having an annular configuration and a lower wallwash reflector, and mating the active body to the wallside body.

Other objects, advantages, and salient features of the invention will become apparent to those skilled in the art from the following detailed description, which, when taken in conjunction with the annexed drawings, discloses exemplary and alternative embodiments of the invention.

BRIEF DESCRIPTION OF THE DRAWINGS

The above and other objects, features, and advantages of certain exemplary embodiments of the present invention will be more apparent from the following detailed description, taken in conjunction with the accompanying drawings in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and detailed elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
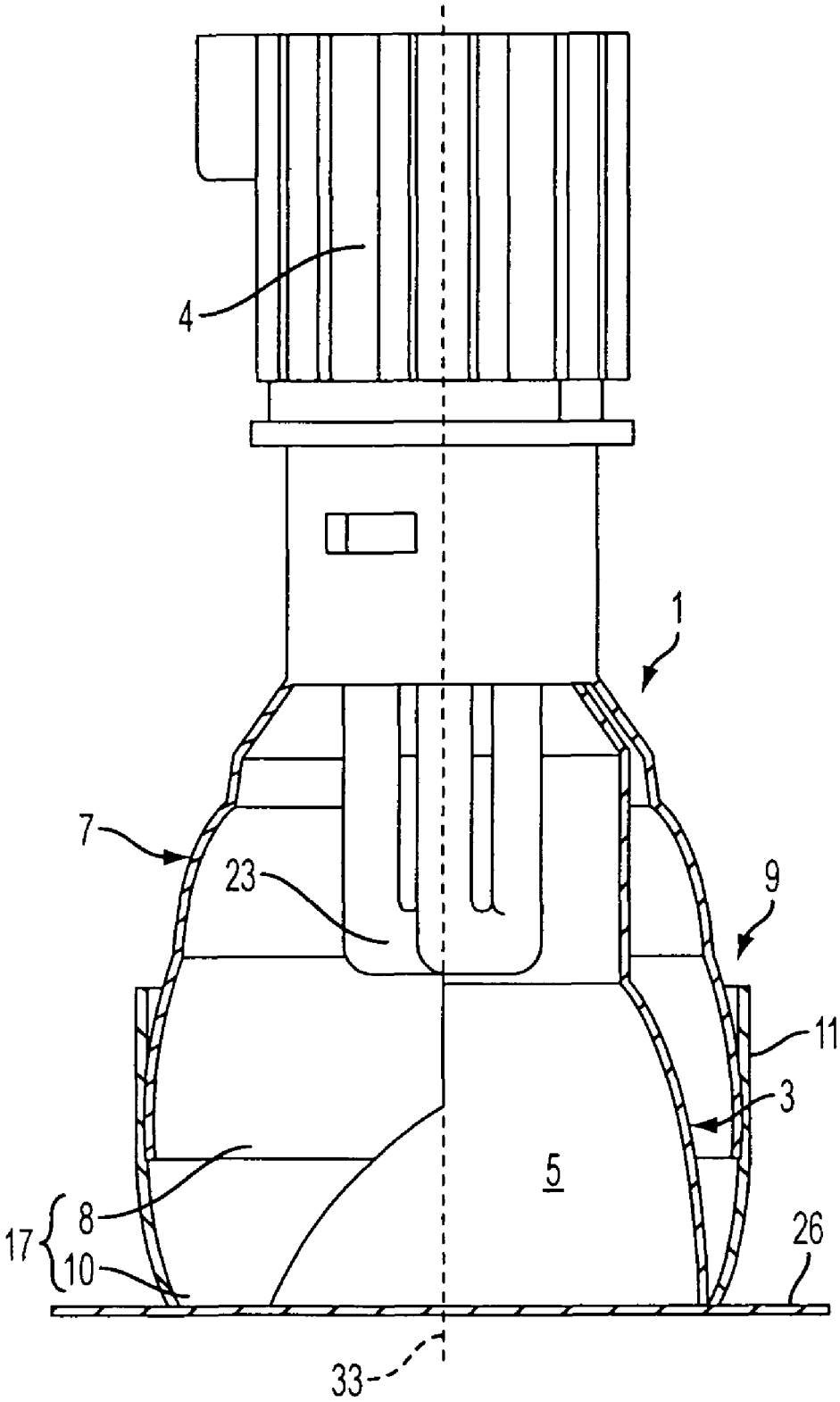
FIG. 1 is a partial cross-sectional elevational view of an exemplary embodiment of a wallwash reflector assembly in accordance with the present invention.
Figure 2:
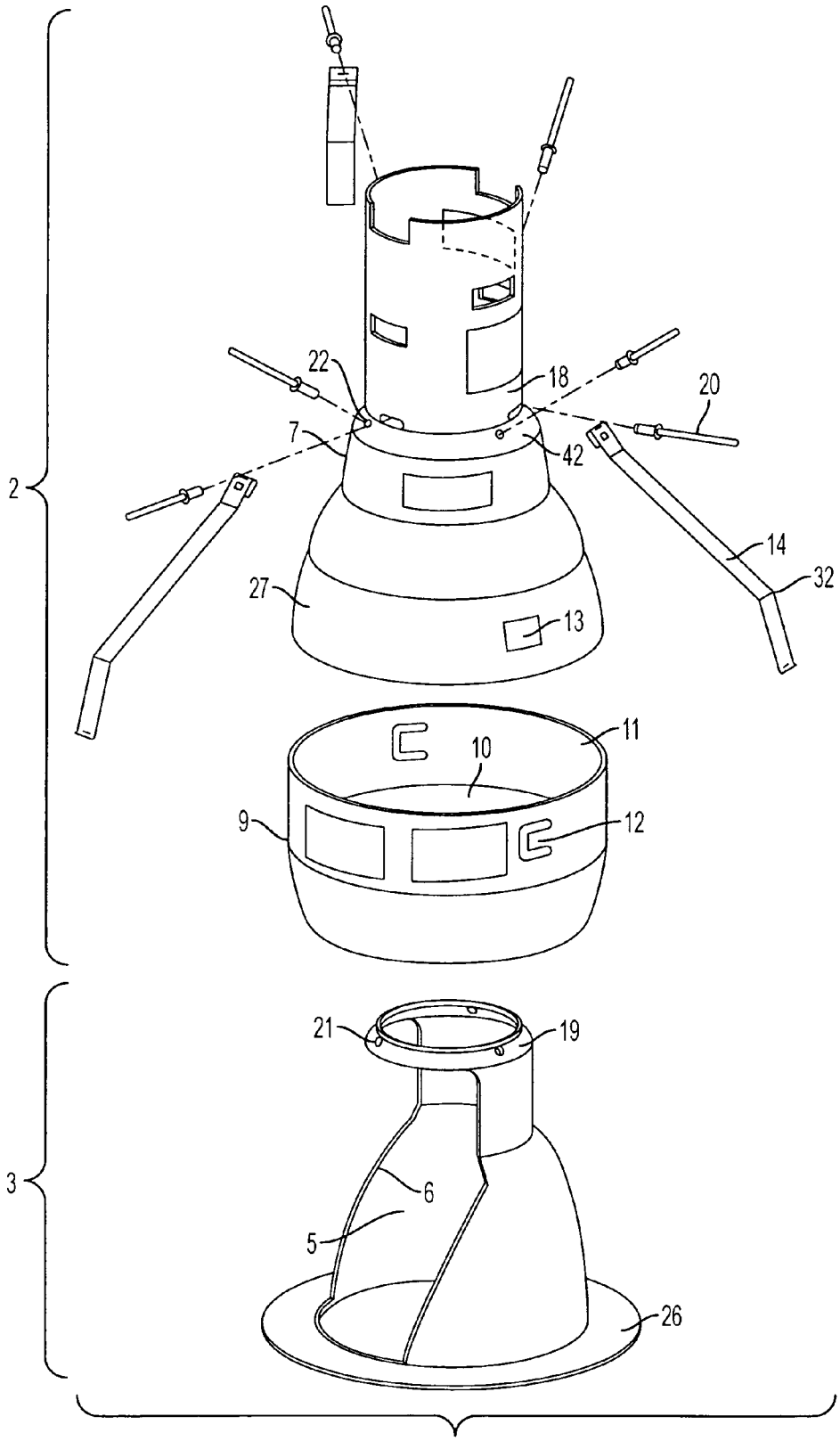
FIG. 2 is an exploded perspective view of an exemplary embodiment of a wallwash reflector assembly in accordance with the present invention as shown in FIG. 1.
Figure 6:
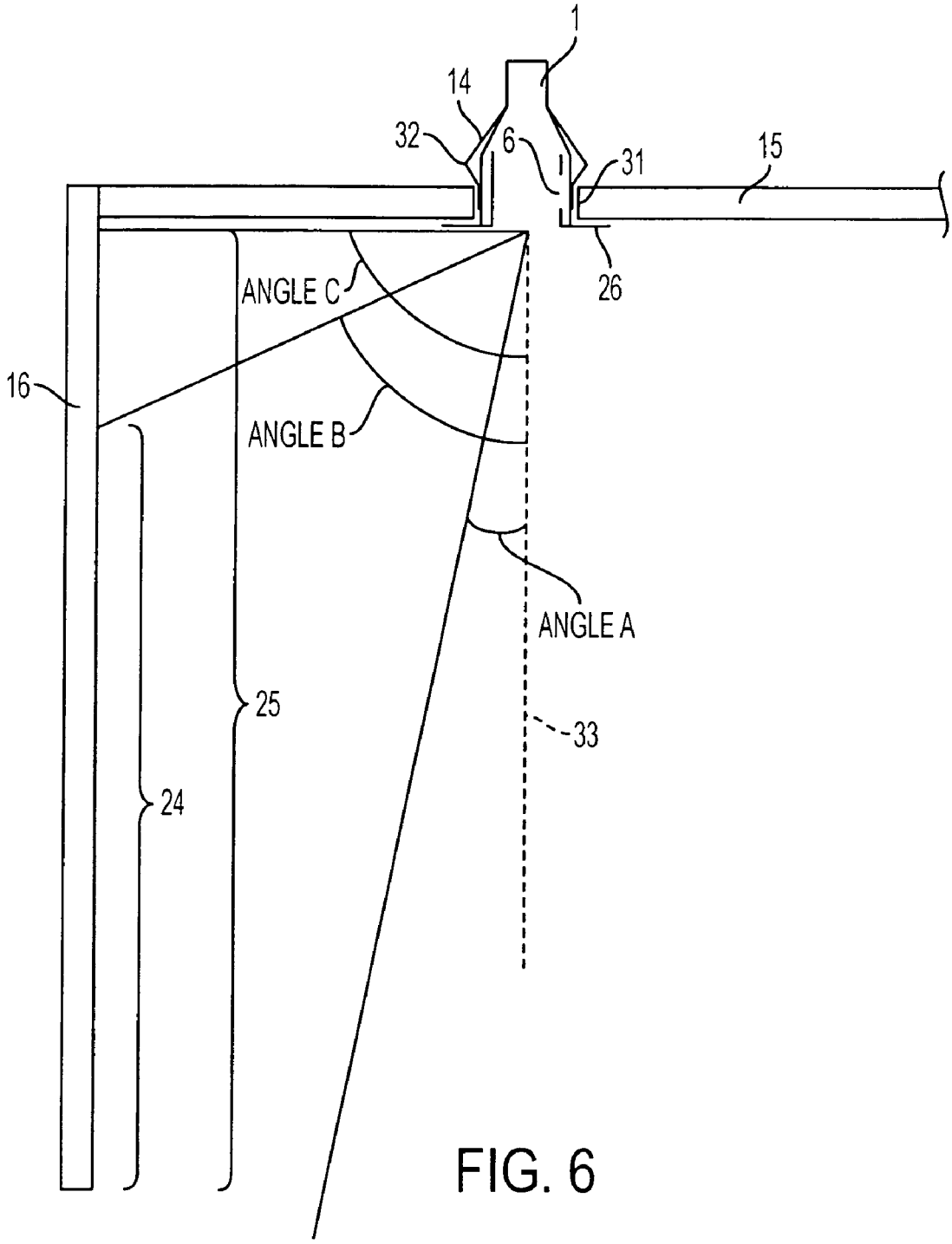
FIG. 6 is an elevational schematic view of a wallwash reflector assembly mounted in a mounting surface and illuminating an adjacent wall and an architectural space in accordance with an exemplary embodiment of the present invention.

Referring to the exemplary embodiment illustrated in FIGS. 1, 2, and 6, a wallwash reflector assembly 1 for indoor lighting is provided. The wallwash reflector assembly 1 resembles a downlight reflector assembly from the architectural space and is held securely within a mounting surface opening 31 of a mounting surface 15. Although the mounting surface 15 is illustrated schematically in FIG. 6 as a unitary surface integral with an adjacent wall 16, the mounting surface 15 is preferably a plasterframe held behind an opening of a floor or ceiling in the conventional manner. After the plasterframe is installed in the floor or ceiling, the wallwash reflector assembly 1 is installed in the mounting surface opening 31 (in this case, the plasterframe opening) from the architectural space side of the mounting surface 15 and, thus, is recessed below the floor or above the ceiling of the architectural space. A reflector flange 26, which can be a separate body or an integral part of the wallwash reflector assembly 1, conceals the area of the mounting surface opening 31 that is not covered by the wallwash reflector assembly 1. The reflector flange 26 will lay flush against the mounting surface 15.

In the exemplary embodiment, the wallwash reflector assembly 1 provides general illumination to the architectural space and also uniformly illuminates from top to bottom at least one non-horizontal surface (i.e. wall 16) (FIG. 6) of the architectural space that is adjacent to the mounting surface 15. In that regard, the wallwash reflector assembly 1 includes a wallwash body 2 (FIG. 2) and a downlight body 3. In the exemplary embodiment, the wallwash body 2 and the downlight body 3 are composed of a substantially rigid, reflective material, such as aluminum. In the exemplary embodiment, the wallwash body 2 has an annular configuration and includes a wallwash body upper end 18 and a wallwash reflector 17 at an end opposite the wallwash body upper end 18. Between the wallwash body upper end 18 and the wallwash reflector 17 is a curved connector portion 42 which is discussed in more detail below. The downlight body 3 has an annular configuration and includes a downlight body upper end 19 and a downlight reflector 5 at an end opposite the downlight body upper end 19. The downlight body 3 is positioned within the wallwash body 2 such that the wallwash body 2 at least partially surrounds the downlight body 3. The wallwash body 2 has no significant vertical cuts as to maintain the design intent.

In the exemplary embodiment, a socketcup 4 is mounted to the wallwash reflector assembly 1. The function of the socketcup 4 is to position at least one light source 23 inside the wallwash reflector assembly 1, as well as to connect at least one light source 23 to a power source (not shown). In the exemplary embodiment, the light source 23 is vertically mounted to the socketcup 4 along the centerline axis 33 of the wallwash reflector assembly 1. In an alternative embodiment, the light source 23 is horizontally mounted and centered at the centerline axis 33 of the wallwash reflector assembly 1. The types of light sources 23 can be chosen from, in non-limiting examples, incandescent lamps, high-intensity discharge lamps, light emitting diode sources, or compact fluorescent lamps. In alternative embodiments, there can be a plurality of adjacent light sources 23 mounted to the socket cup 4, the combination thereof centered on the centerline axis 33 of the wallwash reflector assembly 1. The socketcup 4 is detachably secured to the wallwash body upper end 18, which has a cylindrical configuration. Of course, one of ordinary skill in the art would recognize that the socketcup 4 could be detachably secured to the downlight body upper end 19, or be made integral with the wallwash body upper end 18 or the downlight body upper end 19 without departing from the spirit and scope of the invention. The socketcup 4 is positioned such that the light source 23 extends to within the wallwash body 2 and the downlight body 3 such that light is reflected from both the wallwash reflector 17 and the downlight reflector 5 as discussed in more detail below.

In the exemplary embodiment, the downlight body 3 includes an integral reflector flange 26 projecting radially outward from the free end of the downlight reflector 5 along mounting surface 15. As shown in FIG. 1, the reflector flange 26 acts as a seat for the free end of the wallwash reflector 17 (which, in the exemplary embodiment, is at the free end of the wallside body 9 of the wallwash body 2 as discussed in more detail below). The reflector flange 26 also acts to locate the wallwash reflector assembly 1 relative to the mounting surface 15 as discussed in more detail below. The downlight body 3 also includes at least one cutout 6, which exposes at least one portion of the wallwash reflector 17 to the inside of the wallwash reflector assembly 1 and to the light source 23. In the exemplary embodiment, a cutout 6 exists where a designed percentage of the circumference of the downlight body 3 is cut away, such that the desired portion of the wallwash reflector 17 is exposed to illuminate the desired width of at least one wall 16. In alternative embodiments, the designed percentage of the circumference that is the cutout 6 in the downlight body 3 can be larger or smaller to expose a larger or smaller portion of the wallwash reflector 17 to the inside of the wallwash reflector assembly 1 to accommodate wall 16 width variations or if it is desired to illuminate an alternative width of at least one wall 16. Once installed, the wallwash reflector assembly 1 is rotated such that each exposed portion of the wallwash reflector 17 faces the direction of each wall 16 to be illuminated.

Figure 9A:
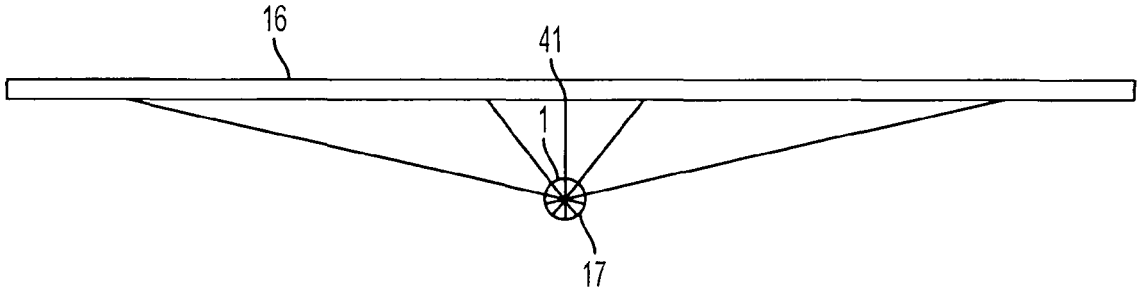
FIG. 9A is a top schematic view of illumination of a wall that is a flat surface.
Figure 9B:
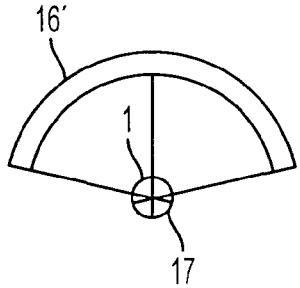
FIG. 9B is a top schematic view of illumination of a wall that is a circularly concave surface.

The wall 16 can be a flat surface (FIG. 9A) or a non-flat surface (FIG. 9B). In either application, the cutouts 6 will expose a portion of the wallwash reflector 17, which will uniformly illuminate the wall 16 from top to bottom. In an application with a flat wall 16, the maximum illuminance on the wall 16 is found at the section 41 of the wall 16 that is the closest to the wallwash reflector assembly 1. As the distance from the wallwash reflector assembly 1 to the wall 16 grows, the illuminance on the wall 16 decreases steadily from the maximum illuminance. As the wallwash reflector 17 is annular in its design, the wallwash reflector assembly 1 directs light over a large lateral distance. In an application with a circularly concave wall 16', the wallwash reflector assembly 1 can be mounted at the center point of the circle and the cutout 6 will expose a portion of the wallwash reflector 17, which will uniformly illuminate the wall 16' from top to bottom and edge to edge. As the distance from the wallwash reflector assembly 1 to the wall 16' never varies, the illuminance on the wall 16' will not vary laterally over the entire length of the wall 16'.

Figure 3:
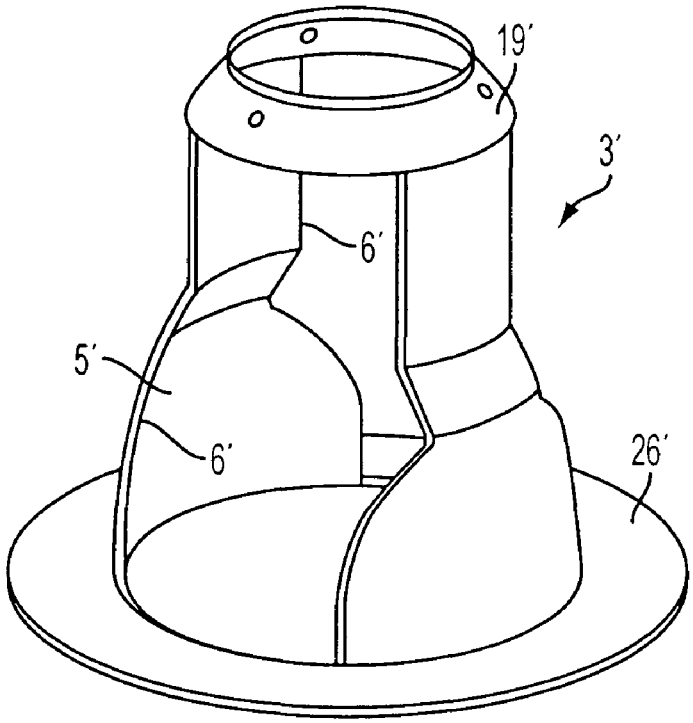
FIG. 3 is a perspective view of an alternative embodiment of a downlight body in accordance with the present invention.

In an alternative embodiment illustrated in FIG. 3, the downlight body 3' includes two opposed symmetrical cutouts 6' which expose opposed portions of the wallwash reflector 17 to simultaneously illuminate opposed walls 16 adjacent to the mounting surface 15. If there are multiple cutouts 6' in the downlight body 3', the cutouts 6' can be symmetrical or the cutouts 6' can be asymmetrical. The quantity, size, shape, and location on the downlight body 3' of the cutouts 6' can be further modified as needed to tailor the illumination provided by the wallwash reflector 17 of the wallwash reflector assembly 1 to illuminate each wall 16 adjacent to the mounting surface 15, as well as to tailor the illumination provided by the downlight reflector 5' of the wallwash reflector assembly 1 to illuminate the architectural space. The downlight body upper end 19' and the reflector flange 26' do not need to be altered in order to accommodate the multiple cutouts 6'. As the cutouts 6' are tooled, for example, using a 5-axis laser or a 5-axis mill, the design possibilities of the cutouts 6' are unlimited and new customized cutout 6' designs can be incorporated with no additional capital expense.

The downlight reflector 5 directs light to provide general illumination to the architectural space. In the exemplary embodiment, the downlight reflector 5 has a sharp intensity cutoff, low luminance at high vertical angles, and high visual comfort. These qualities are a result of the downlight reflector 5 having a profile (in the areas not cut out to expose the wallwash reflector 17) that is the same as the reflector profile disclosed in U.S. Pat. No. 6,357,894. The disclosure of U.S. Pat. No. 6,357,894 is hereby incorporated herein by reference in its entirety.

In the exemplary embodiment, the downlight body upper end 19 of the downlight body 3 is attached to the connector portion 42 of the wallwash body 2 via rivets 20 penetrating through downlight holes 21 in the downlight body upper end 19 and corresponding wallwash holes 22 in the connector portion 42. Of course, one of ordinary skill in the art would recognize that the downlight body 3 can also be connected to the wallwash body 2 via screws, bolts, a welded connection, or the like without departing from the spirit and scope of the invention.

The wallwash reflector 17 of the wallwash body 2 reflects light from the light source 23 such that at least one wall 16 adjacent the mounting surface 15 is illuminated. As discussed above, each cutout 6 in the downlight reflector 5 exposes a portion of the wallwash reflector 17 to the inside of the wallwash reflector assembly 1 and to the light source 23. Each exposed portion of the wallwash reflector 17 faces the direction of a wall 16 to be illuminated.

The following description is of a cross sectional view of the architectural space including the mounting surface 15, the wall 16 adjacent to the mounting surface 15, and the centerline axis 33 of the wallwash reflector assembly 1 (FIG. 6 and FIG. 1). The wallwash reflector 17 includes an upper wallwash reflector 8 for directing light to illuminate a first portion 24 of the wall 16 and a lower wallwash reflector 10 for directing light to illuminate a second portion 25 of the wall 16. The first portion 24 and the second portion 25 partially overlap vertically. The upper wallwash reflector 8 directs light from nadir to Angle B. The upper wallwash reflector 8 includes four distinct curved sections as seen in FIG. 1. The lower wallwash reflector 10 directs light from Angle A to Angle C. As Angle C is larger than Angle B as measured from the nadir of the wallwash reflector assembly 1, the second portion 25 of each wall 16 starts at a vertically closer location to the mounting surface 15 than the first portion 24 of each wall 16 as illustrated in FIG. 6. The contour of the lower wallwash reflector 10 maximizes Angle C, the amount of light on the wall 16, and the efficiency of the wallwash reflector assembly 1.

In the exemplary embodiment, a cutout 6 exists where a designed percentage of the height of the downlight body 3 is cut away, such that the desired portion of the wallwash reflector 17 is exposed to illuminate the desired height, from a starting height to a finishing height, of at least one wall 16. In alternative embodiments, the designed percentage of the height of the cutout 6 in the downlight body 3 can be taller or shorter to expose a larger or smaller portion of the wallwash reflector 17 to the inside of the wallwash reflector assembly 1 to accommodate wall 16 height variations or if it is desired to illuminate an alternative portion of the height of at least one wall 16. In the exemplary embodiment, the cutouts 6 measure a 1/16 of an inch above the reflector flange 26, which maximizes Angle C, the amount of light on the wall 16, and the efficiency of the wallwash reflector assembly 1.

Each cutout 6 exposes a portion of the upper wallwash reflector 8 and a portion of the lower wallwash reflector 10, which are adjacent to each other and, when combined, illuminate each wall 16 in the above-described manner. In the exemplary embodiment, the wallwash body 2 is a multi-piece body including two bodies. One body is the active body 7 that includes the wallwash body upper end 18, the connector portion 42, and the upper wallwash reflector 8. The second body is the wallside body 9 that includes the structural portion 11 and the lower wallwash reflector 10 and at least partially surrounds the active body 7.

In the exemplary embodiment, the active body 7 and the wallside body 9 each have an annular configuration and are composed of a substantially rigid, reflective material, such as aluminum. In the exemplary embodiment, the wallside body 9 includes an annular structural portion 11, which engages the outer surface 27 of the active body 7. In an alternative embodiment, the wallwash reflector 17 is a single piece having an annular configuration and composed of a substantially rigid, reflective material, and including both the upper wallwash reflector 8 and the lower wallwash reflector 10. In the exemplary embodiment, the profiles of both the upper wallwash reflector 8 and the lower wallwash reflector 10 comprise an ellipse or a series of splined ellipses that are optically optimized to evenly illuminate each adjacent wall 16.

In the exemplary embodiment, the wallside body 9 includes at least one tab 12 integrally formed in the structural portion 11 of the wallside body 9, each of which engages one slot 13 in the active body 7 in order to attach the wallside body 9 to the active body 7 as well as to stabilize the wallside body 9. Preferably, two tabs 12 integrally formed in the structural portion 11 of the wallside body 9 engage two corresponding slots 13 in the active body 7. Every slot 13 in the active body 7 is located in an area of the upper wallwash reflector 8 that is not exposed to the light source 23 or to the inside of the wallwash reflector assembly 1 by any cutouts 6 in the downlight reflector 5 and, therefore, none of the slots 13 will alter the distribution of light from the upper wallwash reflector 8. Also, this allows for every slot 13 to be hidden away from view from the inside of the wallwash reflector assembly 1. Alternatively, the slots 13 can be in the structural portion 11 of the wallside body 9 and the tabs 12 in the active body 7 without departing from the spirit and scope of the invention. Alternatively, springs, clips, or like hardware can be applied to attach the wallside body 9 to the active body 7 without departing from the spirit and scope of the invention.

Figure 4:
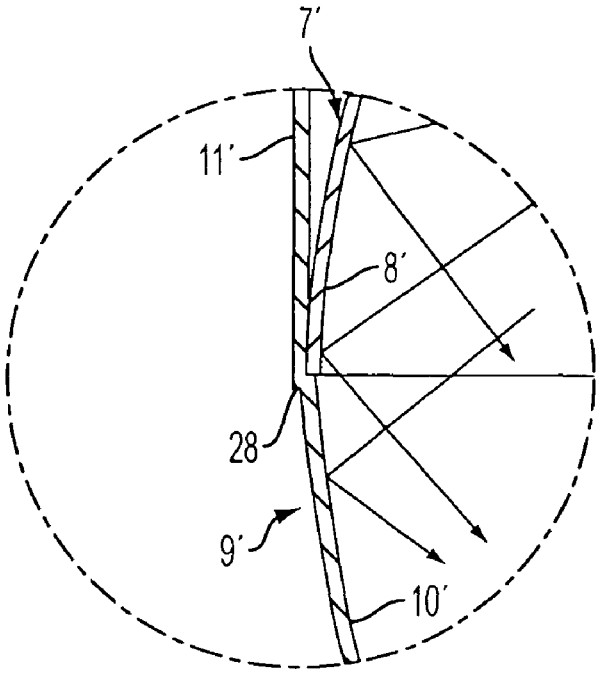
FIG. 4 is a detailed enlarged view of the physical transition between the upper wallwash reflector and the lower wallwash reflector in accordance with an alternative embodiment of the present invention.
Figure 5:
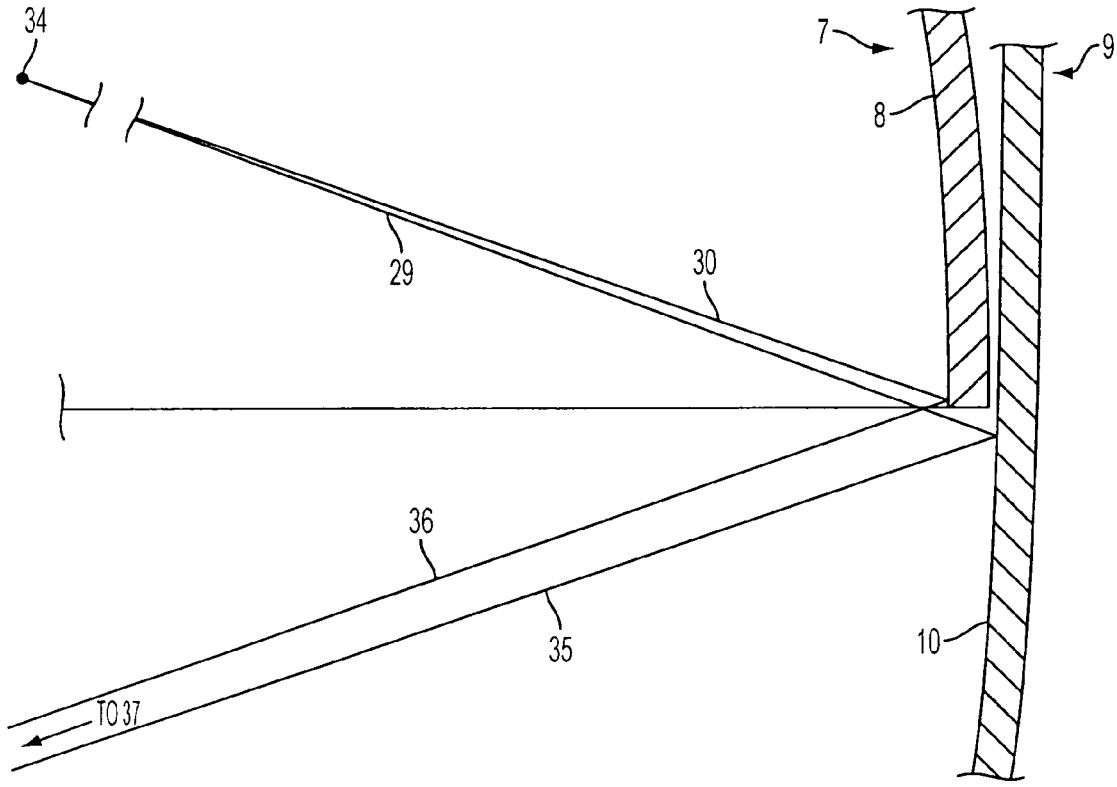
FIG. 5 is a detailed enlarged view of the physical transition between the upper wallwash reflector and the lower wallwash reflector in accordance with an exemplary embodiment of the present invention.

The physical transition between the upper wallwash reflector 8' and the lower wallwash reflector 10' in an alternative embodiment is illustrated in FIG. 4. In this alternative embodiment, the wallside body 9' includes an inward step 28 from the structural portion 11' to the lower wallwash reflector 10'. The inward step 28 helps to position the active body 7', in particular by engaging with the free end of the upper wallwash reflector 8'. This positions the upper wallwash reflector 8' relative to the wallside body 9' and, therefore, to the lower wallwash reflector 10'. By contrast, in the exemplary embodiment as illustrated in FIG. 5, there is no inward step 28 in the wallside body 9, and there is a slight clearance between the overlapping portions of the active body 7 and the wallside body 9. The active body 7 and the wallside body 9, and therefore the upper wallwash reflector 8 and the lower wallwash reflector 10, are positioned relative to each other laterally by the previously discussed tab/slot connection. The active body 7 and the wallside body 9 and, therefore the upper wallwash reflector 8 and the lower wallwash reflector 10, are positioned relative to each other vertically by use of the reflector flange 26, the rivets 20, and by the upper wallwash reflector 8 and the lower wallwash reflector 10 themselves.

FIG. 5 illustrates in schematic form the physical transition between the upper wallwash reflector 8 and the lower wallwash reflector 10 according to the exemplary embodiment. The physical transition between the upper wallwash reflector 8 and the lower wallwash reflector 10 is optically optimized. The location of an illumination focal point 34 is chosen in relation to the light source 23 (or to the plurality of light sources in alternative embodiments) and the downlight reflector 5. The location of an aperture focal point 37 is chosen in relation to the aperture opening of the wallwash reflector assembly 1, most particularly with the edge of the aperture opening. The ellipse that makes up the contour of the lower wallwash reflector 10 proximal to the physical transition and the ellipse that makes up the contour of the upper wallwash reflector 8 proximal to the physical transition have the same illumination focal point 34 and aperture focal point 37. From the illumination focal point 34 relative to the light source or sources 23 and the downlight reflector 5, the uppermost light ray 29 that is possible for the lower wallwash reflector 10 to receive will reflect off of the lower wallwash reflector 10 as is represented by the uppermost light ray reflection 35. From the illumination focal point 34 relative to the light source or sources 23 and the downlight reflector 5, the lowermost light ray 30 that is possible for the upper wallwash reflector 8 to receive will reflect off of the upper wallwash reflector 8 as represented by the lowermost light ray reflection 36. The uppermost light ray reflection 35 and the lowermost light ray reflection 36 are in extreme proximity to each other. A continuous light image (i.e. the reflection of the light source or sources 23 and the upper reflector of the downlight reflector 5) is produced and preserved vertically throughout the transition from the upper wallwash reflector 8 to the lower wallwash reflector 10 at all lateral angles, aside from the shading of the lower wallwash reflector 10 as discussed below. The benefit of this optical optimization is that the illumination of each wall 16 will be uniform and have smooth illuminance transitions. The illumination of each wall 16 will not be adversely affected by the physical transition between the upper wallwash reflector 8 and the lower wallwash reflector 10. In FIG. 5, the illustrated vertical distances between the uppermost light ray 29 and the lowermost light ray 30 and between the uppermost light ray reflection 35 and the lowermost light ray reflection 36 are exaggerated for ease of understanding the figure. In reality, by design, they will virtually overlap.

Figure 8:
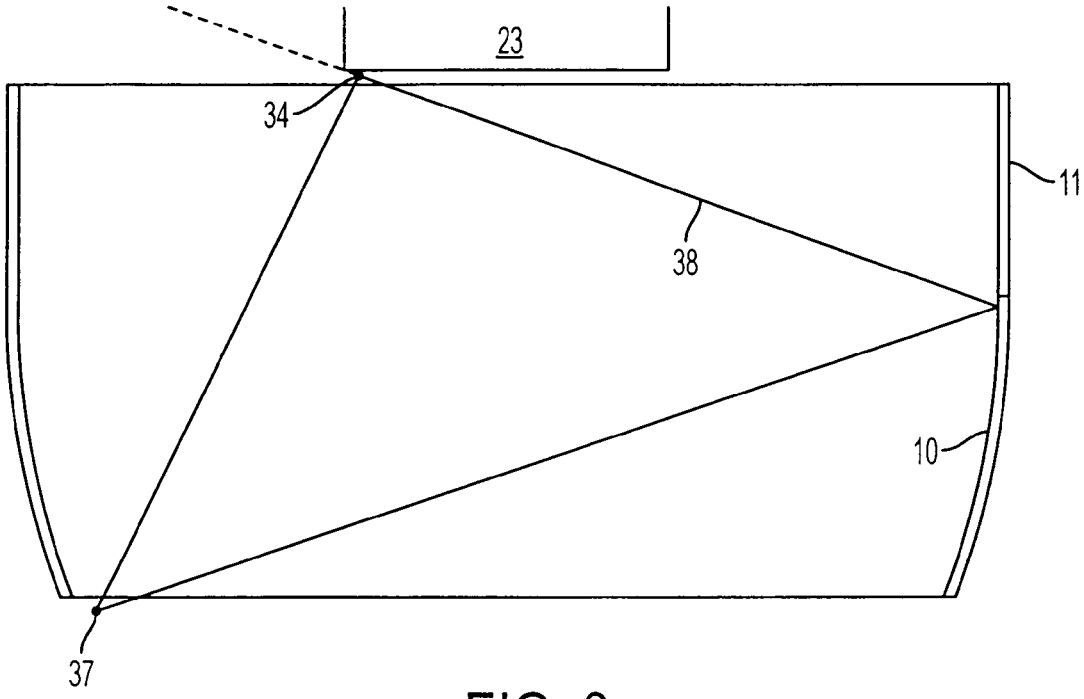
FIG. 8 is a schematic view of an ellipse that makes up the contour of the lower wallwash reflector in accordance with an exemplary embodiment of the present invention.

The location of an illumination focal point 34 is chosen in relation to the light source or sources 23 and the downlight reflector 5. The location of an aperture focal point 37 is chosen in relation to the aperture opening of the wallwash reflector assembly 1, most particularly with the edge of the aperture opening. Each ellipse that makes up the contours of the lower wallwash reflector 10 and the upper wallwash reflector 8 utilize an illumination focal point 34 and an aperture focal point 37 as the two focal points of the ellipse. FIG. 8 illustrates these features schematically. The locations of the illumination focal points 34 and the aperture focal points 37 are chosen to maximize the amount of light exiting the wallwash reflector assembly 1 and, therefore, to maximize the efficiency of the wallwash reflector assembly 1.

All light rays exiting from the light source or sources 23 will be redirected by the upper wallwash reflector 8, the lower wallwash reflector 10, the downlight reflector 5, or will exit the wallwash reflector assembly 1 without having been redirected. The ellipse rays 38 include an illumination focal point 34 and each point on the elliptical contour curve. The locations of the illumination focal points 34 are the physically highest points inside the wallwash reflector assembly 1 that will not result in any light rays crossing from beneath the ellipse rays 38 to above the ellipse rays 38 from the light source or sources 23 or otherwise. Light rays crossing from beneath the ellipse rays 38 to above the ellipse rays 38 cause light to reflect to and then off of the downlight reflector 5 at high vertical angles. Light rays from the light source or sources 23 or otherwise cross the ellipse rays 38 from above it to below it and the high visual comfort of the wallwash reflector assembly 1 is maintained. The higher the locations of the illumination focal points 34 are in the wallwash reflector assembly 1, the more efficient the wallwash reflector assembly 1 will be. There will be multiple illumination focal points 34 for a wallwash reflector assembly 1 design as there will be multiple ellipses that make up the upper wallwash reflector 8 and the lower wallwash reflector 10 contours. The aperture focal points 37 are close to the edge of the aperture, as this optimizes the efficiency of the wallwash reflector assembly 1. However, the aperture focal points 37 are not so close to the wallwash reflector assembly 1 as to result in light reflecting off of the downlight reflector 5 at high vertical angles.

Figure 7A:
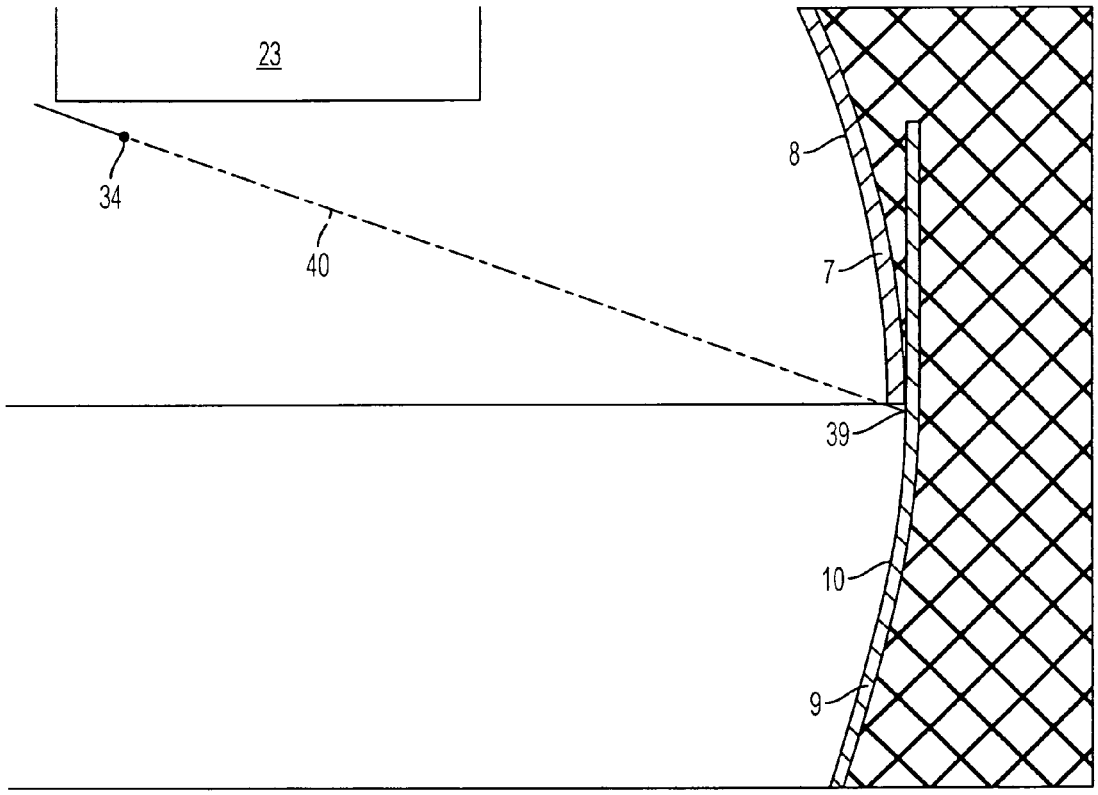
FIG. 7*a* is a shaded detail view of the physical transition between the upper wallwash reflector and the lower wallwash reflector in accordance with an exemplary embodiment of the present invention.

FIG. 7*a* schematically illustrates the surfaces and edges of the wallwash body 2 that will receive light from the light source or sources 23 and the downlight reflector 5 of the wallwash reflector assembly 1. The upper wallwash reflector 8 is represented with a line not bounded by cross-hatched shading, as it will receive light from the light source or sources 23 or the downlight reflector 5 throughout its entire height. The lower wallwash reflector 10 is represented with a line not bounded by cross-hatched shading, as it will receive light from the light source or sources 23 or the downlight reflector 5 from the free end of the lower wallwash reflector 10 up to the location 39 where the active body 7 begins to shade it from the light source or sources 23 and downlight reflector 5. This location 39 is determined by drawing a line 40 from the lowermost edge of the upper wallwash reflector 8 to the lowermost physical location of either the light source or sources 23 or the upper reflector of the downlight reflector 5, taking into account compound angles, and extending this line to the lower wallwash reflector 10. This line 40 will pass nearby the illumination focal point 34 of the ellipse that makes up the proximal contour to the location 39 of the lower wallwash reflector 10 and the ellipse that makes up the proximal contour to the location 39 of the upper wallwash reflector 8. The intersection of this line 40 and the lower wallwash reflector 10 is this location 39.

The area of the lower wallwash reflector 10 that cannot receive light from the light source or sources 23 or downlight reflector 5 is shown as a line bounded by cross-hatched shading in FIG. 7*a*. The bottom surface of the active body 7 is also shown as a line bounded by cross-hatched shading as this surface cannot receive light from the light source or sources 23 or downlight reflector 5. The edge between the upper wallwash reflector 8 and the bottom surface of the active body 7 is controlled and intentional and, therefore, non-relevant to the optical result of the wallwash reflector assembly 1 as the bottom surface of the active body 7 is cut with a sharp knife. The structural portion 11 of the wallside body 9 cannot receive light from the light source or sources 23 or downlight reflector 5 and is illustrated as a line bounded by cross-hatched shading.

Figure 7B:
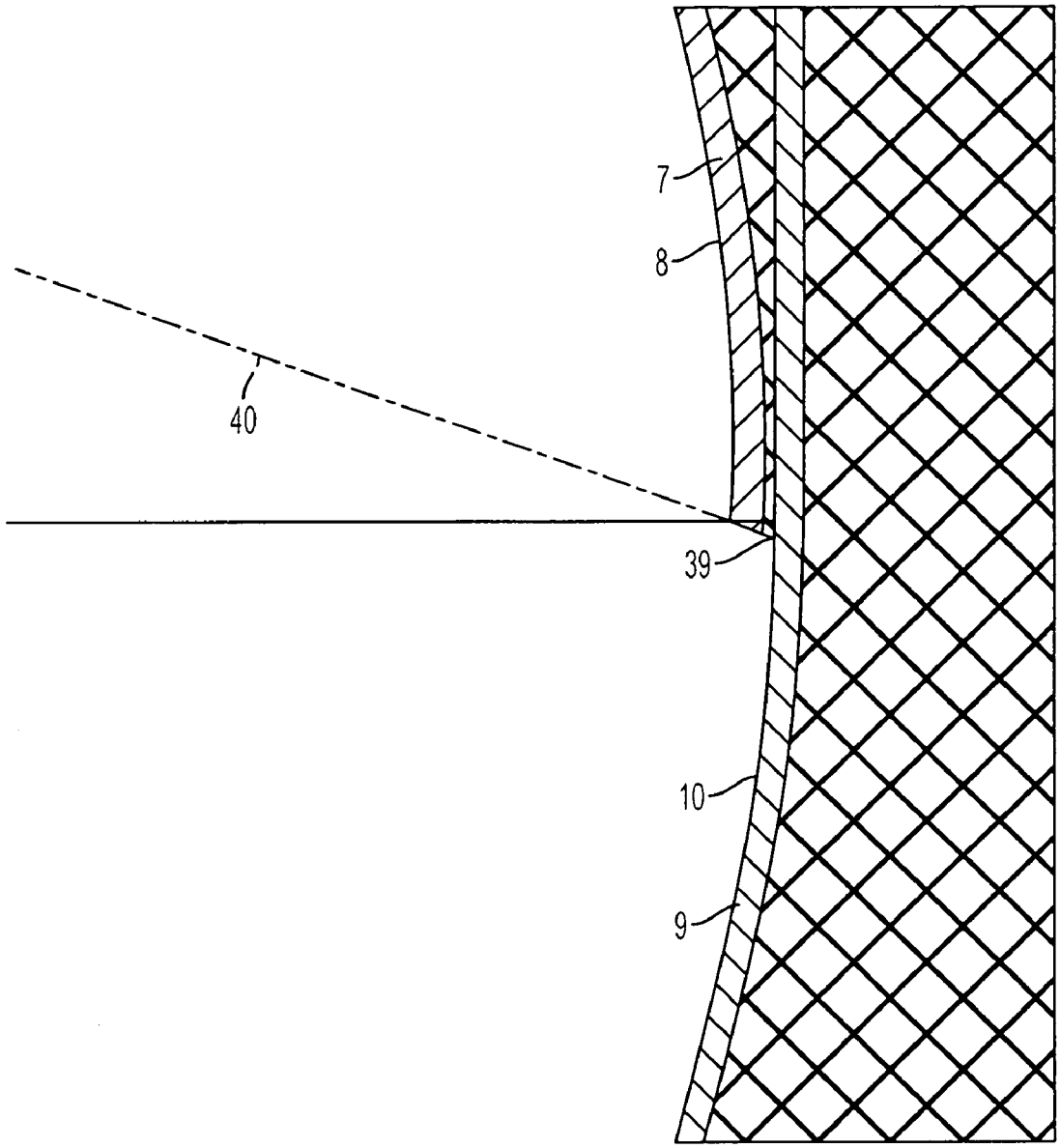
FIG. 7*b* is an enlarged detail view of FIG. 7*a*.

A blown up schematic illustration of the physical transition between the upper wallwash reflector 8 and the lower wallwash reflector 10 is shown in FIG. 7*b*. The lines not bounded by cross-hatched shading represent controlled, intentional, and designed surfaces, which reflect with purpose the light from the light source or sources 23 and the upper reflector of downlight reflector 5 vertically and at all lateral angles of the wallwash reflector assembly 1, and the lines bounded by cross-hatched shading represent surfaces hidden from view from (i.e. having no form factor with) the light source or sources 23 and the downlight reflector 5. All surfaces are accounted for.

This methodology eliminates undesired bright spots or dark spots on the walls 16. An example of an undesired dark spot on the wall 16 is the formation of an "eyebrow" effect. Instead, optical optimization of the upper wallwash reflector 8 and the lower wallwash reflector 10 as described above provides a smooth, imperceptible transition between the illumination provided to each wall 16 by the upper wallwash reflector 8 and the illumination provided to each wall 16 by the lower wallwash reflector 10.

This methodology eliminates the "flashing" effect that occurs when light rays are reflected to and then off of the downlight reflector 5 into the architectural space at high vertical angles. The optical optimization of the upper wallwash reflector 8 and the lower wallwash reflector 10 as described above results in maximizing the light output of the wallwash reflector assembly 1 due to each light ray being directed with purpose and intention.

As shown in FIG. 6, the wallwash reflector assembly 1 is retained within the mounting surface 15 via a plurality of leaf springs 14. In the exemplary embodiment, the leaf springs 14 are riveted to the wallwash body upper end 18. The leaf springs 14 can also be riveted to the connector portion 42. In an alternative embodiment, the leaf springs 14 are riveted to the downlight body upper end 19. Of course, one of ordinary skill in the art would recognize that the leaf springs 14 can also be connected to the wallwash reflector assembly 1 via screws, bolts, a welded connection, or the like without departing from the spirit and scope of the invention. In installing the wallwash reflector assembly 1 of the exemplary embodiment, the wallwash reflector assembly 1 is placed into the mounting surface opening 31 from inside the architectural space with the socketcup 4 preceding the reflector flange 26. The wallwash reflector assembly 1 can be installed into and removed from the mounting surface opening 31 at all lateral rotation angles. As the wallwash reflector assembly 1 is moved into the mounting surface opening 31, the leaf springs 14 are physically forced to straighten and move towards the wallwash reflector assembly 1 as they pass through the mounting surface opening 31. Once the joints 32 of the leaf springs 14 have cleared the mounting surface opening 31, they begin to bend and move away from the wallwash reflector assembly 1 as they favor their unstressed state. Before the leaf springs 14 can extend back to their unstressed state, the reflector flange 26 meets the mounting surface 15 and the wallwash reflector assembly 1 is held in place as shown in FIG. 6.

In the installed state, the wallwash reflector assembly 1 is free to be horizontally rotated to any angle within a 360-degree range of rotation relative to the mounting surface 15 such that the direction of the light reflected from the wallwash reflector 17 to illuminate each wall 16 can be finely adjusted. In the exemplary embodiment, the wallwash reflector assembly 1 is removed from the mounting surface opening 31 by pulling the reflector flange 26 towards the interior of the architectural space. As the wallwash reflector assembly 1 is removed from the mounting surface 15, the leaf springs 14 are physically forced to straighten and move towards the wallwash reflector assembly 1. Once the joints 32 of the leaf springs 14 have cleared the mounting surface opening 31, the wallwash reflector assembly 1 is removed. In the exemplary embodiment, the same mounting surface 15 will receive the wallwash reflector assembly 1 in any customized configuration as well as downlight reflectors. In alternative embodiments, the wallwash reflector assembly 1 has laterally locking positions. In other alternative embodiments, the wallwash reflector assembly 1 is retained via wing nuts, grip clips, or the like.

In the exemplary embodiment, the method of making the two-piece wallwash body 2 comprises forming the active body 7 on a single tool (for example, by spinning or hydroforming), forming the wallside body 9 on a single tool (for example, by spinning or hydroforming), and mating the active body 7 and the wallside body 9 via slots 13 formed in the active body 7 connecting with tabs 12 formed on the wallside body 9. In mating the bodies, the wallside body 9 is placed around the active body 7 such that the tabs 12 and slots 13 align, and then the tabs 12 are bent such that they protrude within the slots 13 to fix the bodies together. Alternatively, the slots 13 can be in the wallside body 9 and the tabs 12 in the active body 7 without departing from the spirit and scope of the invention. Applying this method of manufacturing the wallwash body 2 results in applying tools of high quality that are easy to use and maintain. As a result each wallside body 9 and active body 7 is precise, consistent, and easy to manufacture.

In an alternative embodiment, the wallwash body 2 is one piece, which contains both the upper wallwash reflector 8 and the lower wallwash reflector 10. In order to stay within the spirit and scope of the invention, the physical transition between the upper wallwash reflector 8 and the lower wallwash reflector 10 has to be optically optimized. Manufacturing the wallwash body 2 as one piece and using two tooling processes would not optically optimize the physical transition between the upper wallwash reflector 8 and the lower wallwash reflector 10. This is due to two primary reasons. First, edges and surfaces that are not intentional and controlled are exposed to the light source 23, the downlight reflector 5, and the inside of the wallwash reflector assembly 1 with no care taken to shield them. Second, the two separate tools are maintained separately over time and the parts will vary over tool usage as a result. Manufacturing the wallwash body 2 as one piece by applying a two tool spinning and hydroforming process results in an unavoidable crease in the transition between the area of the wallwash reflector 17 formed by one tool (the upper wallwash reflector 8) and the area of the wallwash reflector 17 formed by the other tool (the lower wallwash reflector 10), which will result in the undesired "eyebrow" effect on each of the illuminated walls 16 and visible flash from the downlight reflector 5 at high vertical angles. As all surfaces and edges exposed to the light sources 23 and the downlight reflector 5 need to be optically optimized and precise, the required method to form the wallwash body 2 as one piece is to manufacture the wallwash body 2 with a single tool, for example by applying high velocity metal forming.

While the invention has been shown and described with reference to certain exemplary embodiments thereof, it will be understood by those skilled in the art that various changes in form and details may be made therein without departing from the spirit and scope of the present invention as defined by the appended claims and their equivalents.

What is claimed is:

1. A wallwash reflector assembly for placement within a mounting surface adjacent to a wall and for use with a light source, comprising:

a wallwash body having an annular configuration and having an annular wallwash reflector for directing light from the light source to illuminate the wall, the wallwash reflector including an upper wallwash reflector for directing light from the light source to illuminate a first portion of the wall and a lower wallwash reflector coupled to said upper wallwash reflector for directing light from the light source to illuminate a second portion of the wall; and a downlight body received within said wallwash body having a downlight reflector for directing light from the light source to illuminate an architectural space adjacent the wall, the downlight body including a cutout for exposing to the light source to at least a portion of the upper wallwash reflector and at least a portion of the lower wallwash reflector.

2. The wallwash reflector assembly of claim 1, wherein the wallwash reflector assembly has a central axis, and the second portion of the wall receives light from the light source at larger vertical angles from the central axis than the first portion of the wall.

3. The wallwash reflector assembly of claim 1, wherein the lower wallwash reflector has an upper portion at least partially surrounding a lower portion of said upper wallwash reflector.

4. The wallwash reflector assembly of claim 1, wherein the upper wallwash reflector and the lower wallwash reflector are composed of a substantially rigid material and where the upper wallwash reflector has an axial length greater than the axial length of said lower wallwash reflector.

5. The wallwash reflector assembly of claim 1, and further comprising a socketcup for mounting the light source.

6. The wallwash reflector assembly of claim 1, wherein the downlight body includes a reflector flange for locating the wallwash body relative to the downlight body, for stabilizing the wallwash body, and for locating the wallwash reflector assembly relative to the mounting surface.

7. The wallwash reflector assembly of claim 1, wherein the downlight body has an annular configuration.

8. A wallwash reflector assembly for placement within a mounting surface adjacent to a wall and for use with a light source, comprising:

an active body having an annular configuration defining an upper wallwash reflector with an upper portion and a lower portion for directing light from the light source to illuminate a first portion of the wall; and a wallside body having an annular configuration with an annular collar receiving said upper wallwash reflector and having a lower wallwash reflector at a lower end for directing light from the light source to illuminate a second portion of the wall.

9. The wallwash reflector assembly of claim 8, wherein the wallwash reflector assembly has a central axis, and the second portion of the wall receives light from the light source at larger vertical angles from the central axis than the first portion of the wall.

10. The wallwash reflector assembly of claim 8, and further comprising a socketcup for mounting the light source.

11. The wallwash reflector assembly of claim 8, and further comprising a downlight body received within said upper and lower wallwash reflectors and having a downlight reflector for directing light from the light source to illuminate an architectural space adjacent the wall and below said assembly.

12. The wallwash reflector assembly of claim 11, wherein the downlight body includes at least one cutout for exposing to the light source at least a portion of the upper wallwash reflector and at least a portion of the lower wallwash reflector.

13. A wallwash reflector assembly having a central axis, for placement within a mounting surface adjacent to a wall, and for use with a light source, comprising:

an upper wallwash reflector having a concave inner surface with a curvature for directing light from the light source to illuminate a first portion of the wall;

a lower wallwash reflector having a concave inner surface with a curvature for directing light from the light source to illuminate a second portion of the wall, said lower wallwash reflector having an upper end with a dimension to receive a lower end of said upper wallwash reflector to couple said lower wallwash reflector to said upper wallwash reflector; and a downlight body having a downlight reflector for directing light from the light source to illuminate an architectural space adjacent the wall, wherein the downlight body includes two cutouts for exposing to the light source at least two portions of the upper wallwash reflector and at least two portions of the lower wallwash reflector.

14. A wallwash reflector assembly having a center axis for placement within a mounting surface adjacent a wall for directing light from a light source toward said wall and in a downward direction, the assembly comprising:

an upper wallwash reflector having an upper end receiving the light source, an annular bottom end, and a concave inner surface with a curvature for directing light to a lower portion of the wall;

a lower body having an annular collar at an upper end and a lower wallwash reflector at a bottom end, said upper end of said lower body having a diameter greater than a diameter of said bottom end of said upper wallwash reflector and where said bottom end of said upper wallwash reflector is received within and coupled to said upper end of said lower body, said lower wallwash reflector having a concave inner surface with a curvature for directing light to an upper portion of the wall; and a downlight body having an open bottom end and a downlight reflector receiving the light source, the downlight reflector having at least one cutout aligned with said upper and lower wallwash reflectors, to direct light reflected from said wallwash reflectors through said at least one cutout toward the wall.

15. The wallwash reflector of claim 14, wherein said annular collar of said lower body has a substantially cylindrical shape.

16. The wallwash reflector of claim 15, wherein said annular collar has at least one tab extending toward said upper wallwash reflector, and said upper wallwash reflector has a slot for receiving said tab to couple said upper wallwash reflector and lower wallwash reflector together.

17. The wallwash reflector of claim 15, wherein said lower wallwash reflector curves inwardly at said bottom end toward said center axis, and said annular bottom end of said upper wallwash reflector curves outwardly at said bottom end with respect to said center axis.

18. The wallwash reflector of claim 17, wherein said annular bottom end of said upper wallwash reflector mates with an upper end of said lower wallwash reflector, and where the angle of said bottom end of said upper wallwash reflector and the angle of said lower wallwash reflector complement each other to prevent shadow lines on the wall.

19. The wallwash reflector of claim 14, wherein said upper wallwash reflector has a substantially frustoconical shape with a first portion with a concave inner surface adjacent said annular bottom end and a second portion with a concave inner surface adjacent said first concave inner surface, said second portion having a diameter less than a diameter of said first portion.

20. The wallwash reflector of claim 19, wherein said first concave inner surface has an axial length greater than an axial length of said second concave inner surface.

21. The wallwash reflector of claim 19, wherein said first portion has a radius of curvature that is different from a radius of curvature of said second portion.

22. The wallwash reflector of claim 8, wherein said upper portion of said active body has a concave inner surface for directing light to said first portion of said wall, and said lower portion of said active body has a concave inner surface for directing light to a portion of said wall between said first portion of the wall and second portion of the wall.

23. The wallwash reflector of claim 22, wherein said lower wallwash reflector has a bottom end that converges inwardly toward an axial center of said lower wallwash reflector and extends radially inwardly with respect to a bottom end of said upper wallwash reflector.

* * * * *